US010309108B2

(12) United States Patent
Sanabra Loewe

(10) Patent No.: US 10,309,108 B2
(45) Date of Patent: Jun. 4, 2019

(54) PILLAR FOR SUPPORTING A MODULAR STRUCTURE, BEAM INTENDED TO BE SUPPORTED ON PILLARS OF THIS TYPE, AND STRUCTURE COMPRISING SAID PILLARS AND BEAMS

(71) Applicant: Elastic Potential, S.L., Barcelona (ES)

(72) Inventor: Marc Sanabra Loewe, Barcelona (ES)

(73) Assignee: ELASTIC POTENTIAL, S.L., Barcelona (ES)

( * ) Notice: Subject to any disclaimer, the term of this patent is extended or adjusted under 35 U.S.C. 154(b) by 0 days.

(21) Appl. No.: 15/324,226

(22) PCT Filed: Jul. 9, 2014

(86) PCT No.: PCT/ES2014/070562
§ 371 (c)(1),
(2) Date: Jan. 5, 2017

(87) PCT Pub. No.: WO2016/005616
PCT Pub. Date: Jan. 14, 2016

(65) Prior Publication Data

US 2017/0159294 A1 Jun. 8, 2017

(30) Foreign Application Priority Data

Jul. 9, 2014 (ES) ..... 201431031

(51) Int. Cl.
*E04B 1/21* (2006.01)
*E04C 3/34* (2006.01)
(Continued)

(52) U.S. Cl.
CPC ..... *E04C 3/34* (2013.01); *E04B 1/21* (2013.01); *E04B 1/48* (2013.01); *E04B 5/06* (2013.01);
(Continued)

(58) Field of Classification Search
CPC ... E04C 3/34; E04C 3/20; E04C 5/125; E04B 5/04; E04B 1/21; E04B 5/06
See application file for complete search history.

(56) References Cited

U.S. PATENT DOCUMENTS 915,421 A * 3/1909 Eisen ..... 52/236.9
1,031,043 A * 7/1912 Conzelman ..... E04B 5/43 256/19
(Continued)

FOREIGN PATENT DOCUMENTS

DE 2010146 A1 * 9/1971 ..... E04B 1/02
EP 3034715 A1 * 6/2016 ..... E04C 3/34
(Continued)

OTHER PUBLICATIONS

PCT International Search Report, Application No. PCT/ES2014/070562, Spanish Search Authority, Mar. 18, 2015, 7 pages.

*Primary Examiner* — Christine T Cajilig

(57) ABSTRACT

Precast concrete column (1) for the support of structural modular floor, preferably dry assembled, comprising in its upper part a capital for the support (2) of beams (3), having the support capital (2) a square or quadrangular plan in such a way that four sides (21, 22, 23, 24) are defined for the support of the beams (3), in which each of the sides (21, 22, 23, 24) comprises concave recesses (4) of sides parallel to the axis of the beams (3) that define convex protrusions (5) which sides comprise bearing surfaces (6) such that when laying a beam (3), which ends are complementary to said recesses (4), the bearing forces have directions contained in a plane (41, 42, 43, 44) perpendicular to the axis of the beam (3), having said directions a horizontal component. The invention also refers to a beam complementary to this column and to slab segments, as well as to a structure provided with said columns, said beams and optionally also said slab segments.

13 Claims, 17 Drawing Sheets

(51) Int. Cl.

| | |
|---|---|
| ***E04C 3/20*** | (2006.01) |
| ***E04B 1/48*** | (2006.01) |
| ***E04C 5/10*** | (2006.01) |
| ***E04C 5/12*** | (2006.01) |
| ***E04B 5/06*** | (2006.01) |
| ***E04B 5/43*** | (2006.01) |
| *E04B 1/22* | (2006.01) |

(52) U.S. Cl.
CPC ..... *E04B 5/43* (2013.01); *E04C 5/10* (2013.01); *E04C 5/125* (2013.01); *E04B 1/22* (2013.01)

(56) References Cited

U.S. PATENT DOCUMENTS 1,380,324 A * 5/1921 Piggins ..... E04B 1/215 52/236.7
1,407,277 A * 2/1922 Ingberg ..... E04C 3/30 403/173
1,516,074 A * 11/1924 Borg ..... E04B 1/21 52/236.9
2,580,174 A * 12/1951 Henderson ..... E04B 1/21 52/259
2,618,146 A * 11/1952 Ciarlini ..... E04B 1/21 52/236.6
3,074,209 A * 1/1963 Henderson ..... E04B 1/215 52/220.2
3,903,667 A * 9/1975 Zetlin ..... E04B 5/43 52/220.3
3,918,222 A * 11/1975 Bahramian ..... E04B 5/04 29/452
5,507,124 A * 4/1996 Tadros ..... E04B 5/43 52/251
2004/0237439 A1* 12/2004 Powell ..... E04B 1/20 52/505
2011/0283638 A1* 11/2011 Shockley ..... E04B 5/43 52/231
2015/0013255 A1* 1/2015 Hunt ..... E04B 1/20 52/236.3

FOREIGN PATENT DOCUMENTS

| | | |
|---|---|---|
| ES | 2127885 | 5/1995 |
| GB | 569636 | 6/1945 |
| GB | 606691 | 8/1948 |
| GB | 2 149 874 | 6/1985 |
| JP | 2010203184 | 9/2010 |

* cited by examiner

PILLAR FOR SUPPORTING A MODULAR STRUCTURE, BEAM INTENDED TO BE SUPPORTED ON PILLARS OF THIS TYPE, AND STRUCTURE COMPRISING SAID PILLARS AND BEAMS

The present invention refers to a concrete precast column for the support of structural dry assembled modular floor, to a wide beam, to slab segments and to the structural framework composed of these elements, which allows simple assembling and post-tensioning procedures, limiting the logistical problems, and offering structures of noteworthy span with the possibility to compose flat and statically indeterminate floors.

BACKGROUND OF THE INVENTION

Precast concrete structural framework systems are known that comprise some or various of the three types of basic elements that compose the system described hereafter: support columns, with or without capital; beams supported on the columns; and slab segments supported on beams or directly on the columns.

There are many variants among the multiple framework systems of this kind. For a better understanding of which aspects differ from some variants to others, nine essential features of this kind of structure are established:

A) Existence of a CAPITAL on top of the column.

B) Geometry of the BEAMS, namely, of the elements or parts of the floor that are directly supported on the columns.

C) Section of the SLAB, or of the part of the floor that is not directly supported on the columns, but it does on the beams.

D) SIZE and SHAPE of the precast elements.

E) Type of REINFORCEMENT used in the floor, namely in the beams and slabs.

F) ONE-WAY or TWO-WAY direction of the floor and, in particular, of the slab.

G) Solution for the SUPPORT of precast elements on others, especially during the assembling process.

H) Solution for the CONTACT in the zone of support between one element of precast concrete and its support, especially during the assembling process.

I) Solution to grout or not the JOINTS between elements.

A) Capital

Examples of this kind of structural frameworks in which the columns do not have capitals are described in GB1084094 (Zezelj), U.S. Pat. No. 3,495,341 (Mitchell Jr), U.S. Pat. No. 3,553,923 (Dompas) and U.S. Pat. No. 5,504,124 (Tadros).

Examples of this kind of structural frameworks in which the columns do have capitals are described in U.S. Pat. No. 2,776,441 (Dobell), U.S. Pat. No. 3,918,222 (Bahramian) and U.S. Pat. No. 8,011,147 (Hanlon). In the latter case the capital is not quadrangular.

B) Beams

An example of this kind of structural frameworks in which the beams are narrow and protrude under the slab is described in U.S. Pat. No. 2,776,441 (Dobell).

Examples of this kind of structural frameworks in which the beams are wide but protrude under the slab are described in U.S. Pat. No. 3,495,341 (Mitchell Jr), U.S. Pat. No. 3,918,222 (Bahramian), U.S. Pat. No. 5,504,124 (Tadros) and U.S. Pat. No. 8,011,147 (Hanlon).

Examples of this kind of structural frameworks in which the beams are wide and flat or indistinct to the ensemble of the slab are described in GB1084094 (Zezelj) and U.S. Pat. No. 3,553,923 (Dompas).

C) Slab

An example of this kind of structural frameworks in which the slabs are solid is described in U.S. Pat. No. 3,495,341 (Mitchell Jr)

Examples of this kind of structural frameworks in which the slabs have a T-section are described in GB1084094 (Zezelj), U.S. Pat. No. 3,918,222 (Bahramian) and U.S. Pat. No. 8,011,147 (Hanlon).

Examples of this kind of structural frameworks in which the slabs have double-T or box section are described in U.S. Pat. No. 2,776,441 (Dobell), U.S. Pat. No. 3,553,923 (Dompas) and U.S. Pat. No. 5,504,124 (Tadros).

D) Size and Shape

Examples of this kind of structural frameworks in which the precast elements are small blocks or segments are described in U.S. Pat. No. 2,776,441 (Dobell) and U.S. Pat. No. 3,553,923 (Dompas).

An example of this kind of structural frameworks in which the elements are flat and of big dimensions is described in GB1084094 (Zezelj).

Examples of this kind of structural frameworks in which the elements are long and of big dimensions are described in U.S. Pat. No. 3,495,341 (Mitchell Jr), U.S. Pat. No. 3,918,222 (Bahramian), U.S. Pat. No. 5,504,124 (Tadros) and U.S. Pat. No. 8,011,147 (Hanlon).

E) Reinforcement

Examples of this kind of structural frameworks with passive reinforcement are described in U.S. Pat. No. 3,495,341 (Mitchell Jr) and U.S. Pat. No. 5,504,124 (Tadros).

An example of this kind of structural frameworks with pretensioned reinforcement is described in U.S. Pat. No. 8,011,147 (Hanlon).

Examples of this kind of structural frameworks with post-tensioned reinforcement are described in U.S. Pat. No. 2,776,441 (Dobell), GB1084094 (Zezelj), U.S. Pat. No. 3,553,923 (Dompas) and U.S. Pat. No. 3,918,222 (Bahramian).

F) One-Way or Two-Way Flexure

Examples of this kind of structural frameworks made of elements with flexure in one direction (one-way flexure) are described in U.S. Pat. No. 2,776,441 (Dobell), U.S. Pat. No. 3,495,341 (Mitchell Jr), U.S. Pat. No. 5,504,124 (Tadros) and U.S. Pat. No. 8,011,147 (Hanlon).

Examples of this kind of structural frameworks made of elements with flexure in two directions (two-way flexure) are described in GB1084094 (Zezelj), U.S. Pat. No. 3,553,923 (Dompas) and U.S. Pat. No. 3,918,222 (Bahramian).

G) Support

Concerning the way in which the elements are supported on others, at least three families can be distinguished: the ones that use supports on metal parts, provisional or definitive; the ones that use half lap supports in concrete; and ones that use more or less complex geometries of interlocking between elements, by means of metallic or concrete edges, which are able to transmit non-vertical efforts.

Examples of this kind of structural frameworks with joints that use supports on metal parts are described in GB1084094 (Zezelj) and U.S. Pat. No. 8,011,147 (Hanlon).

The precast structural frameworks with joints that use half lap supports in concrete are much more common. Among the structural frameworks of the type studied here, examples of half lap support are described in U.S. Pat. No. 2,776,441

(Dobell), U.S. Pat. No. 3,495,341 (Mitchell Jr), U.S. Pat. No. 3,918,222 (Bahramian) and U.S. Pat. No. 5,504,124 (Tadros).

Examples of joints that use interlocking complex geometries between elements that can transmit non-vertical efforts are described in US409893 (Wrey), US24114438 (Henderson), U.S. Pat. No. 2,618,146 (Ciralini), U.S. Pat. No. 2,966,009 (Koch) and others. In general all these examples are not very prevailing, typical of a solution that has been proven to be more appropriate to other materials (wood, metals, etc.) than to concrete.

H) Contact

Concerning the contact between the elements of precast concrete and the element on which they are supported, the four following solutions can be differentiated: butt joint (direct support) on concrete; butt joint (direct support) on steel; on a base of mortar; and on a base of elastomer.

Examples of this kind of structural frameworks with butt joint contact between concrete and concrete are described in U.S. Pat. No. 2,776,441 (Dobell), U.S. Pat. No. 3,495,341 (Mitchell Jr), U.S. Pat. No. 3,553,923 (Dompas), U.S. Pat. No. 3,918,222 (Bahramian) and U.S. Pat. No. 5,504,124 (Tadros).

Examples of this kind of structural frameworks with butt joint contact between concrete and steel are described in GB1084094 (Zezelj) and U.S. Pat. No. 8,011,147 (Hanlon). The solutions with mortar or with elastomer are more common for the support of precast elements on elements executed on site.

I) Joints

Regarding the way in which the gaps between elements in the joints are resolved, at least three families can be differentiated: the one using an open joint that gets grouted with mortar or concrete; those in which the joints present gaps quite small but imperfect, which do not get grouted; and those in which the joint allows such a perfect interlocking, whether metallic or made of concrete, that it does not require grouting.

An example of this kind of structural framework with joints that use open joint that gets grouted with mortar or concrete is described in GB1084094 (Zezelj).

Examples of this kind of structural frameworks with joints that use joints with small gaps small that do not get grouted are described in U.S. Pat. No. 3,495,341 (Mitchell Jr), U.S. Pat. No. 3,918,222 (Bahramian), U.S. Pat. No. 5,504,124 (Tadros) and U.S. Pat. No. 8,011,147 (Hanlon).

Examples of joints with perfect interlocking without concrete grouting are described in US409893 (Wrey), U.S. Pat. No. 2,618,146 (Ciralini), U.S. Pat. No. 2,966,009 (Koch) and others. In general all these are not very prevailing examples, typical of a solution that has been proven to be more appropriate to other materials (wood, metals, etc.) than to concrete.

Each of the variants of the nine essential features previously described for the design of structural systems has its limitations. These are described hereafter following the same criteria of the nine essential features.

A) Capital

The systems that do not use capitals have, as their major problem, strong efforts in the joints of the column and the elements it bears. Furthermore, being these joints of small dimensions, they turn out to be almost impossible to reinforce. This often limits a lot the ability of this kind of frameworks to absorb efforts of negative flexure, and also very significantly reduces the shear strength of the joints. That is why this type of systems often has limited spans and limited maximal loads. However, the systems using columns with solidary capitals do not have these strength and stiffness limitations in negative flexure zones. Despite this, they entail a logistic problem due to their irregular geometry.

B) Beams

The systems that use narrow (downdropping) beams, pose the obvious problem of the lack of flatness of the floors, leading to functional issues. Nevertheless they are much more efficient in structural terms than wide (nondropping) beams.

The wide (nondropping) beams are in the opposite situation, they have less structural efficiency, but offer flat floors. The lack of structural efficiency of this kind of beams, in many cases can be compensated increasing the width of the beam and/or its reinforcement. In the case of prestressed beams, and even more in those having post-tensioned reinforcement, this lack of efficiency, may also be compensated by increasing the prestress load, which means increasing the amount of reinforcement. Wide beams that drop under the slab are in a transition situation between the narrow (downdropping) beam and the wide (nondropping) beam.

C) Slab

The structural systems with solid slab have the limitation of a worse sitffness/weight ratio than slabs with voided sections. Despite this, the solid slabs have a significantly greater shear strength than voided sections (T sections or double T sections). That is why they are suitable for elements under significant loads.

The systems with T section slabs have a better stiffness/weight ratio—this is particularly true under positive moments. However, they have a quite lower performance under negative moments.

Those systems with double T section (or box section) slabs have the best sitffness/weight ratio both under positive and negative moments. Furthermore, these sections are much more suitable to prestressing than T sections, because they can stand greater prestress loads at transfer. In any case their biggest inconvenient is that they often need concrete being poured in 2 phases.

D) Size and Shape

Those structural systems that use small precast elements or segments may have some advantages on a logistic level, but have an important limitation during the erection: they need formwork and shoring. Furthermore, in systems of this type the amount of joints is very high and often distributed all over the floor, so they may include more weak points on a level of strength, of stiffness and/or of durability. One last limitation is that the flat floors formed by small elements are only possible using prestressing, and normally by means of post-tensioned reinforcement, since the assembling of the elements is done on site.

On an opposite situation, we may find those systems including big flat elements. This type of elements have many advantages: they do not need shoring or formwork on site, because precast elements they are directly beared on the definitive supports; they can be precast with reinforcement in two directions and therefore they are very suitable to work two-way; and they reduce to the minimum the number of joints between elements and these can be studied so that they can be located in lesser critical zones. Despite their big advantages, they have an important disadvantage, almost insurmountable: their weight and mainly their big dimensions often imply important logistic limitations. This ends up limiting by the maximum size of the elements.

The systems of big and long elements are a compromise solution between the two previous systems, and they gather the advantages of both systems, in order to minimize their disadvantages. Long elements can be designed to be directly beared on their definitive supports, avoiding shoring and props. Because of their geometry, they are not specially suited to be reinforced at the factory with two-way reinforcement. Despite this, on site post-tensioning may achieve these elements to work two-way.

E) Reinforcement

Systems that use passive reinforcement or pretensioned reinforcement but not post-tensioned reinforcement, have two very significant limitations: on one hand, joints are discontinuity points; and on the other, pretensioned reinforcement can only be placed one-way. Passive reinforcement is often one-way, even if there is not much reason for that.

Those systems with passive or pretensioned reinforcement where concrete is not poured on site, or pouring is limited to the joints, as the ones described herein, it is not common to have reinforcement passing through the joints. Furthermore, the concrete poured in the joints has no capacity to resist tensions. In some cases, the existence of non-grouted small gaps between one element and another even prevent the joints to bear compressions. This implies big discontinuities regarding efforts, and an inefficient structural utilization of the elements, resulting in greater needs both of reinforcement and of depth to satisfy strength and stiffness requirements. Furthermore, resulting structures have very low structural redundancy, which means a bigger risk of chain collapse.

In contrast, those systems including passive or pretensioned reinforcement where considerable amounts of concrete is placed on the site have clearly less problems associated to joints discontinuities. The greater the portion of cast in situ concrete, the lesser problems with joints, both between precast elements and between precasts and cast in situ concrete. These type of solutions have among their greater advantages the chance to add passive reinforcement placed in the site, for example in zones under negative moments. Despite the advantages offered by the on site pouring of a part of the concrete, this type of structures keep having at least two limitations: on the one hand execution speed is limited by the need to wait for concrete hardening; and on the other hand pretensioned reinforcement is not continuous from one bay to the other.

Most of the above descrived limitations (joints, one-way flexure) may be solved in those systems using post-tensioned reinforcement.

Post-tensioning the reinforcement offers, in general, significant advantages over the use of passive reinforcement or pretensioned reinforcement. Among these, the possibility of prestressing concrete both under positive and negative flexures stands out; the possibility to erect prestressed cantilevers; and the possibility to close joints between elements which concrete has been poured in different moments. Despite this, using post-tensioned reinforcement in precast poses the two difficulties: on the one hand, threading the reinforcement through the several elements, which must be provided with holes or recesses properly facing each other; and on the other hand, an proper erection process must be foreseen that enables the protection of post-tensioning reinforcement to avoid its rusting must be foreseen, such as injecting the ducts or any other equivalent process. Only GB1084094 (Zezelj) gives a technically feasible solution to these two problems, consisting in placing the bare post-tensioned reinforcement inside an open joint that is subsequently concreted. Despite properly solving the two mentioned problems, a limitation may be pointed out: the layout of the tendons is polygonal. As known, this is a type of layout that is very effective, even if the parabolical tayout is known as more oprtimal. Out of the field of building construction, segmental bridges construction has efficiently solved both watertightness of joints and the problem of holes facing each other. However, this bridges construction technique cannot directly be used in buildings.

F) One-Way or Two-Way Flexure

Those floors made of precast elements that are only capable of developing flexure in a direction (one-way flexure) have significant functional and architectural limitations. The four most important limiations of these floors are described next: a) it is impossible to palce holes (for stair cases, for instance) having its long dimension perpendicular to the flexure direction of the one-way elements; b) placing holes with the long dimension parallel to the flexure of the elements is not free of problems either, since it may enforce using header joists, often scarcely compatible with the one-way logic of the precast elements; c) having cantilevers is often complicated, as it is only possible if one-way elements of the adjoining span ara parallel to those of the cantilever; d) it is very advisable—sometimes unavoidable—to align supports, in order to guarantee that precast elements properly match with each other.

Two-way floors cast in the site do not have any of the previous limitations. Despite this, precast two-way floors are somehow more limited than those cast on the site. Their bigger drawbacks are probably that they pose limitations to the free position of supports, and also to the formation irregular perimeters or irregular holes.

G) Support

Those systems of structural frameworks that use metal parts supports have two limitations: on the one hand, they lead to concentrations of efforts in the bearing points, which must be controlled to avoid local failure of concrete; and on the other hand, metal parts can not be used as joints sealing against leakage, because those are only small isolated metal parts.

Those systems of structural frameworks that use half lap supports have at least two limitations:

First of all, the flatness of the floors is incompatible with a good shear strength of the joints. Normally, one of the two following solutions is choosed: whether the floor is kept flat, but in junction zones elements are under important stresses due to the reduction of depth typical of half lap supports. This, in turn, may lead the overdimensioning of the elements of the junction and/or to important concentrations of reinforcement in these zones. Whether the depth of at least one of the two elements is kept, on the condition that the other will have a greater depth. Of course, the least makes impossible a flat floor.

Secondly, in the event of half lap joints between two elements having both the same depth, it is improbable that the zone of the junction will have the same or a greater stiffness than the elements it joins. This is due to the fact that it is impossible to grout the bottom half of the joint with concrete to restore the stiffness.

Those structural systems that use bearing methods by means of complex geometries of interlocking between elements that can transmit non vertical efforts are not common currently in building precasting, doubtlessly due to their added difficulties in the factory production and the assembly process on site. Despite these problems, nowadays it is usual to fabricate elements with interlocking geometries of a certain geometric complexity, for segmental bridges.

H) Contact

Those systems of structural frameworks that use butt joints bearings, for concrete-to-concrete contact or concrete-to-steel contact, share the advantage of being very easy and fast to put in place, but in return demand smaller production and assembly tolerances. However, beyond the problem of tolerance there is a bigger one. In some types of supports, for example half lap supports, a butt joint support risks to cause that the load is not centred on the supposed bearing surface, and important stress concentrations may occur in small surfaces or in edges, possibly resulting in local failure and subsequent wide-ranging collapses.

Those systems that use supports in which a material (fresh mortar, elastomer, resins) is placed between the surfaces of the two elements in contact solve the two previously mentioned issues: the problem of fabrication and assembly tolerances, and the problem about the centering of the loads. On the other hand, mortar and resins will need workforce in the job. While the elastomer may either be installed on site, or may be included in (or sticked on) the precast element, the latter is an advantage, even if it still is a complication to the factory production process.

I) Joints

Those solutions based in open joint between elements have at least one important limitation: the separation between elements may allow grout leakage. This forces the use of rather dry mortars. Alternatively also some type of formwork may be used. Those joint solutions based in non-grouted small gaps, despite allowing a greater speed and simplicity of construction, have the obvious limitation of causing zones of stiffness discontinuity. This often leads to a noteworthy loss of the structure efficiency along with a reduction of structural redundancy.

Those joint solutions based in a perfect interlocking between elements are hard to implement because the fabrication and assembling tolerances common to concrete elements make it almost impossible in practice to have a totally perfect interlocking. On the other hand, a perfect interlocking of elements often seriously conditions the assembly process. That is why, despite the fact that decades ago this type of solutions appeared in numerous patents, nowadays it is a solution practically non-existent in building construction. Despite this, segmental bridges do use this type of joint, which is linked to both a peculiar production system and an erection process very characteristic of this sort of bridges.

DESCRIPTION OF THE INVENTION

In order to overcome the mentioned disadvantages, the present invention proposes a precast concrete column for the support of a modular structure, comprising at its upper part a bearing capital for beams, the bearing capital having a square or quadrangular plan in such a way that four sides to support the beams are defined, wherein each of the sides comprises concave concrete recesses having sides parallel to the axis of the beams that define convex concrete protrusions which sides comprise bearing surfaces such that when bearing a beam, which ends are complementary to said recesses, the bearing forces have directions contained in a plane perpendicular to the axis of the beams, said forces having a horizontal component.

Preferably, the concave recesses are triangular or trapezoidal, and preferably in a minimum number of two on each side. Despite this, other shapes also offer good results: curved sections, sections with steps (see FIG. 13).

Advantageously, the sides of the concrete recesses intended to support the beams can have elastomer bands attached, to improve the contact between elements and centre the loads.

Even more advantageously, the four sides of the bearing capital for the beams include, in its bottom side, a protruding flap intended to contain the grout used to fill the joints between the beams and the capital of the column.

Alternatively, to overcome the disadvantages previously mentioned, the present invention proposes a concrete precast column for the support of a modular structure comprising at its upper part a bearing capital for beams, the bearing capital having a square or quadrangular plan in such a way that four bearing sides to support the beams are defined, wherein each of the sides includes a rigid protruding flap attached to the bottom side of the capital and possesses rigid vertical rails attached to the vertical side of the capital that, in turn, are parallel to the axis of the beam that is supported on that side, the end side of said beam including rigid and flat plates that fit in the rails of the capital.

Advantageously, the horizontal rigid flaps will be made of fiberglass, of carbon fibre or of steel properly protected to improve its durability, and will be covered by an elastomer band in the support zone to guarantee the centring of the load.

Advantageously, in any of the two variants of the invention, it is envisaged that the bearing capital is to be provided with embedded passing through duct segments, which allow the following threading of the post-tensioning reinforcement.

Any of the two proposed variants allows assembling the beams in a simple and safe way, without formworks or shoring, and without the need to work with too strict tolerances of production or assembly. Additionally, both solutions allow an easy threading of the post-tensioning tendons, because they guarantee that the duct segments included in the precast elements face each other.

The invention also refers to a wide beam of pretensioned precast concrete of rectangular or quadrangular section for modular structure, in such a way that four sides are defined, two of them are end sides for the support on columns, wherein each of the side ends comprises convex recesses of sides parallel to the axis of the beam that comprise bearing surfaces such that, when supporting the beam over the bearing capital of a column provided with protrusions complementary to said recesses, the bearing forces have directions contained in a plane perpendicular to the axis of the beam, said directions having a horizontal component.

Preferably, at least one of the long sides of the beam comprises concave recesses of sides parallel to the short dimension of the beams that comprise bearing surfaces such that when supporting the slab segments, which ends are complementary to said recesses, the bearing forces have directions contained in a plane perpendicular to the axis of the slab segments, having said forces a horizontal component.

Preferably, the concave recesses are triangular or trapezoidal, and preferably in a minimum number of two on each side. Despite this, other shapes also offer good results: curved sections, sections with steps (see FIG. 13).

Advantageously, the sides of the concrete recesses intended to support can have elastomer bands attached, to improve the contact between elements and centre the loads.

Even more advantageously, the sides of the beam that are equipped with concave recesses include, in their bottom side, a protruding flap intended to contain the grout used in the filling of the joints between the slab segments and the beams. The material of the flaps can be quite diverse (steel, aluminium, fibre reinforced mortar, fiberglass, etc.), with the sole requisites of containing the liquid mortar without suffering a deformation that will allow leakage of grout, and being anchored to the concrete mass by means of a system that will not decrease the durability of the precast element.

Alternatively, the invention also refers to a wide beam of prestressed precast concrete of rectangular or quadrangular section for modular structures, in such a way that four sides are defined, two of the end sides for the support on columns, wherein each of the end sides incorporates rigid and flat plates that fit in the rigid rails, these being flat and parallel, included in the vertical side of the bearing capital of the column.

In this alternative solution, preferably, at least one of the long sides of the beam includes a rigid protruding flap and is attached to the bottom side of the beam, and possesses rigid and flat rails included in the vertical side of the beam that, in turn, are parallel to the axis of the slab segments that are supported on that side, the outer side of said slab segments including rigid and flat plates that fit in the rails of the beam.

Advantageously, the horizontal rigid flaps will be made of fiberglass, of carbon fibre or of steel properly protected to improve its durability, and will be covered by an elastomer band in the support zone to guarantee the centring of the load.

Advantageously, in any of the two variants of the invention, it is envisaged that the beam will be provided with embedded passing through duct segments, which allow the subsequent threading of the post-tensioning reinforcement.

In any of the variants of the invention, two classes of beams are differentiated. On the one hand, the main beams 15 (or 115), provided in one of their long sides of bearing edges (concave indentations, rigid flap) for slab segments. And on the other hand, the secondary beams 16 (or 116), which are characterized in not having said support methods for slab segments. Despite the fact that the secondary beams do not support the slab during the assembling phase of the structure, after the tensioning of all the tendons; it is very possible that they support a significant part of the load of the slab.

The invention also refers to a structure composed by at least two columns, a beam and its corresponding post-tensioned reinforcement according to any of the variants of the invention.

Finally, and more preferably, the structure is completed with slab segments of prestressed precast concrete provided in their end sides with convex recesses for the the slab segments to lay on the long sides of the beams, which allow a support in the conditions described in said claim.

Alternatively, the structure is completed with slab segments of prestressed precast concrete and include in each of its end sides rigid and flat plates that fit in the rails of the beam.

Advantageously, in any of the two variants of the invention, it is envisaged that each slab segment will be provided with embedded passing through duct segments, which allow the subsequent threading of the post-tensioning reinforcement.

Even more advantageously, one or both long sides of each slab segment can incorporate in their bottom side a protruding flap intended to contain the grout that is used to fill the joints between two slab segments or between a slab segment and a beam parallel to it.

The material of which the grout contention flaps is made can be quite diverse (steel, aluminium, fibre reinforced mortar, fiberglass, etc.), with the sole requisites of containing the liquid grout without suffering a deformation that will allow grout leakage, and being anchored to the concrete mass by means of a system that will not decrease the durability of the element.

In any case, the tolerances of fabrication and assembly of this type of joints can get to be small enough so that this type of flaps will not be necessary.

The invention here proposed, in any of its variants, solves multiple limitations of the previously existing solutions described through the proposal of new technical solutions. In those cases in which none of the known solutions lacks of limitations, a new solution is not proposed, the chosen solution is the one understood as the less limiting of the known solutions. For bigger clarity, the nine essential features previously mentioned follow:

A) Capital

The invention uses capitals on the columns, as it is considered that the advantages provided (greater structural capacity) overcome the logistic limitations.

B and C) Beams and Slab

The invention does not specifically define the type of section, solid or voided, that have the elements that compose it (capital, beams and slab segments). Despite this, it is understood that the solution that can cover a wider field of needs is the one in which the capitals are solid and the beams that are directly supported on them also are solid, whereas the slab segments are voided, preferably with double-T sections.

This way, the beams, which are elements subjected to greater loads, have a greater stiffness and strength with the same depth. In particular, the solid section of the beams that gives a significant additional strength to shear effort, very much needed in the proximities of the supports. That is why it is also very suited for the capitals to be solid. However, the slab segments, which support a lower proportion of load, normally will not need the additional resistant capacity offered by the solid section. With a double-T section, a significant lightening and saving of material is achieved, which only slightly decreases the strength and stiffness to flexure. On the other hand, being the beams solid and provided with greater stiffness, the voided slabs work as supported on four edges, instead of supported on four (corner) columns. This also implies a significant improvement of its deformability.

D) Size and Shape

The invention foresees the use of big and long elements, because they mean a good compromise solution between the small segments that require formwork and the big and flat ones that pose logistic limitations.

E and F) Reinforcement and One-Way or Two-Way Flexure

The invention foresees the use of pretensioned and post-tensioned reinforcement. The latter preferably two-way disposed, although without excluding the possibility that post-tensioning may only be used in one direction, according to the needs.

The invention does not exclude the use of other reinforcement beyond the pre-tensioning and the post-tensioning. On the contrary, the elements can advantageously contain, in their interior, passive reinforcement in the shape of bars or fibres. All the reinforcings (posttensioned, restressed, passive rebars or fibres) can be made of steel or of another material commonly used to reinforce concrete, such as fiberglass, carbon fibre, aramid, or plastics suited for such function.

Regarding the concrete, it is envisaged that any type can be used, both regarding the type of mortar and the additives and the aggregate, lightweight or heavyweight.

G) Support

Regarding the design of the joints and the bearing system, the proposed solutions present the following advantages regarding the ones described. The proposed bearing systems are halfway between the half lap support and the support with interlockings, trying to minimize the problems of both types and to maximize their virtues. They have the typical advantages of a half lap support (simple assembly) without having to choose between having a weakened section or having a single depth (flat soffit). They manage to have a section with noteworthy shear strength during the erection process besides having a single depth (flat soffit). Additionally the typical problem of the half lap supports between elements of the same depth is avoided, which is that the bottom half of the joint is very hard to fill with grouting. In the proposed invention this gets solved, and grouting the open joints and post-tensioning them restitutes the complete stiffness of the section.

Tolerances of significant assembling in the direction of this axis are allowed, just in the same way that it often happens in half lap bearing. This is typically enabled thanks to the fact that the bearing surfaces of the supporting elements (capital and beam) are parallel to the axis of the supported elements (beam and slab segment respectively).

One additional advantage of the proposed support solution is that it guarantees that the holes for the passage of tendons are facing each other.

Additionally, a typical advantage of the proposed support solution with concave recesses of concrete is that the dry junction (during the erection process) between the elements is equipped with a certain stiffness to torsion in such a way that once the beam is placed over the column, the slab segments can be placed (supported) on the beam without the structure experiencing instability.

H) Contact

Furthermore, in the solution based in supports with concave recesses of concrete the total contact surface is increased, reducing the contact tension between elements. Thanks to that and to the bearing surfaces not being horizontal, the invention allows the butt joint support of the elements to keep a reasonable centring of loads without the need to use interposed materials.

In any case, in this variant of the invention, the use of interposed materials (elastomer, mortar, resins, etc.), can improve the behaviour in case of significant loads or high tolerances of fabrication and assembly.

In the variant of the invention in which the support is done by means of horizontal and rigid flaps, placing an elastomer in the bearing zones is needed to guarantee a proper centering of the loads. The need to use elastomer does not complicate the installation on site, since those may be prefabricated with the elastomer already attached to the support flap.

I) Joints

One of the main disadvantages of the solution based in supports with concave recesses of concrete, caused by the assembling tolerances that it allows, is that the joint remains open in its bottom side, so that leakage preventing flaps in the perimeters of support of the elements are often necessary.

Incidentally, the joints can be grouted with compensated retraction mortar. The use of this material added to the effect of the post-tensioning, allows obtaining a structure without discontinuities of stiffness.

BRIEF DESCRIPTION OF THE FIGURES

For a better comprehension of what has been exposed, drawings have been added in which, schematically and only as a non-limitative example, a practical case of embodiment is represented.

DESCRIPTION OF A PREFERRED EMBODIMENT

Figure 1:
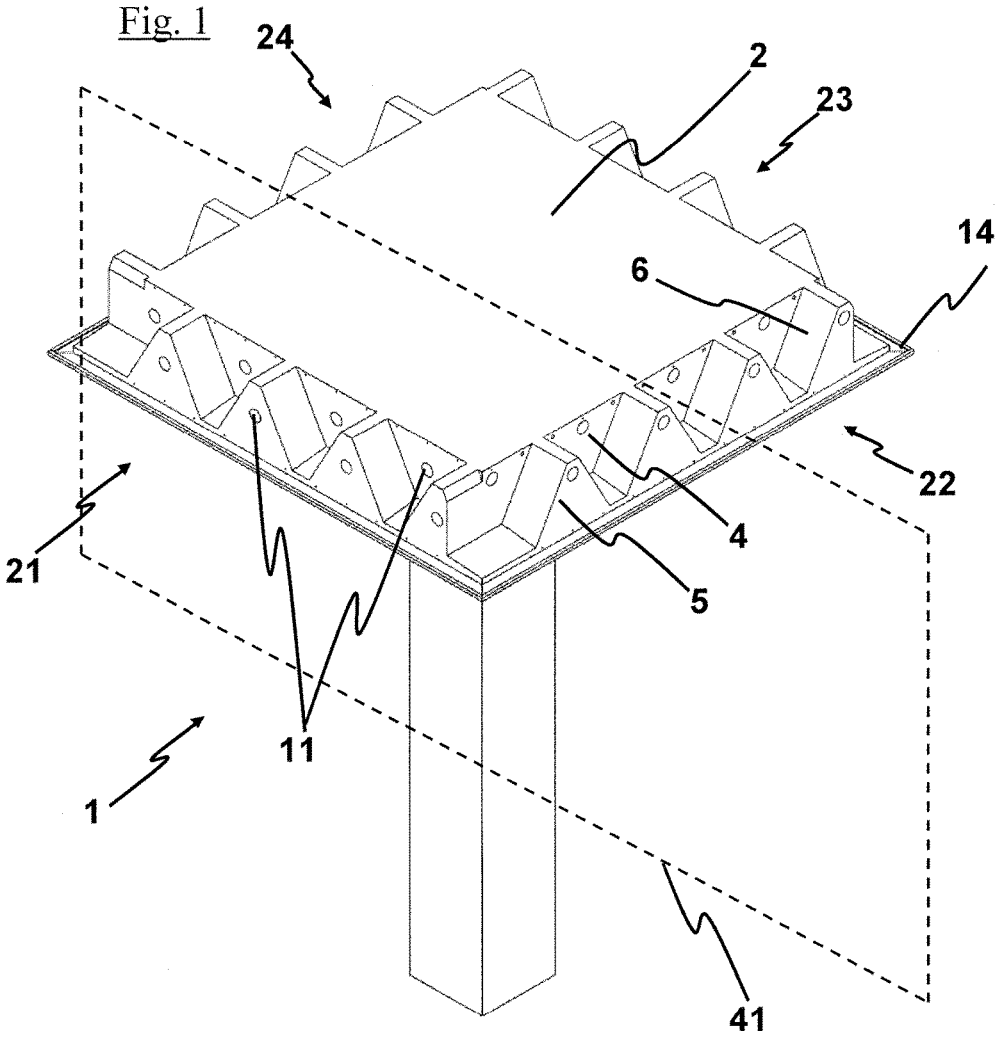
FIG. 1 is a perspective view that shows a column with concave recesses of concrete according to the invention.
Figure 2:
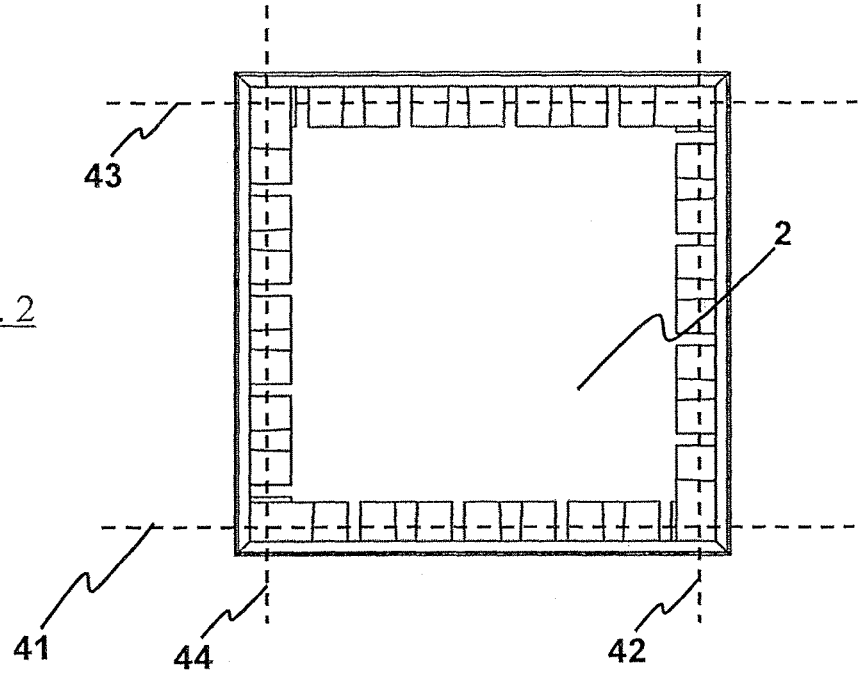
FIG. 2 is a plan view of the capital of the column.
Figure 3:
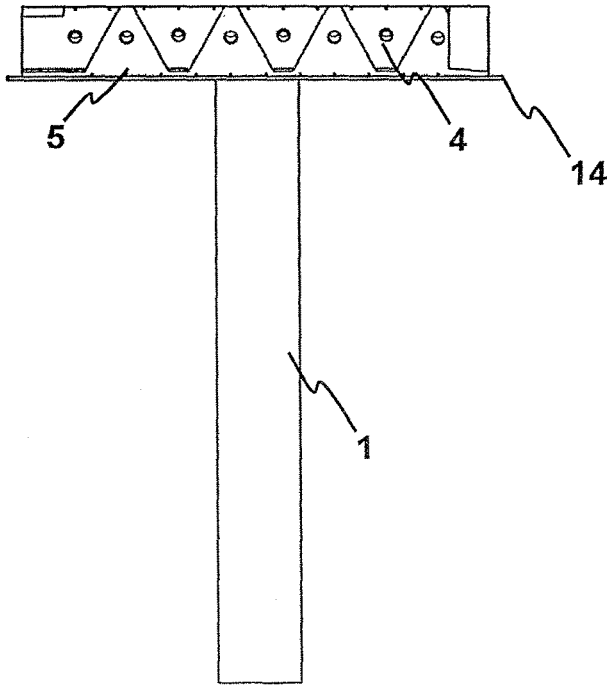
FIG. 3 is an elevation of the column.
Figure 4:
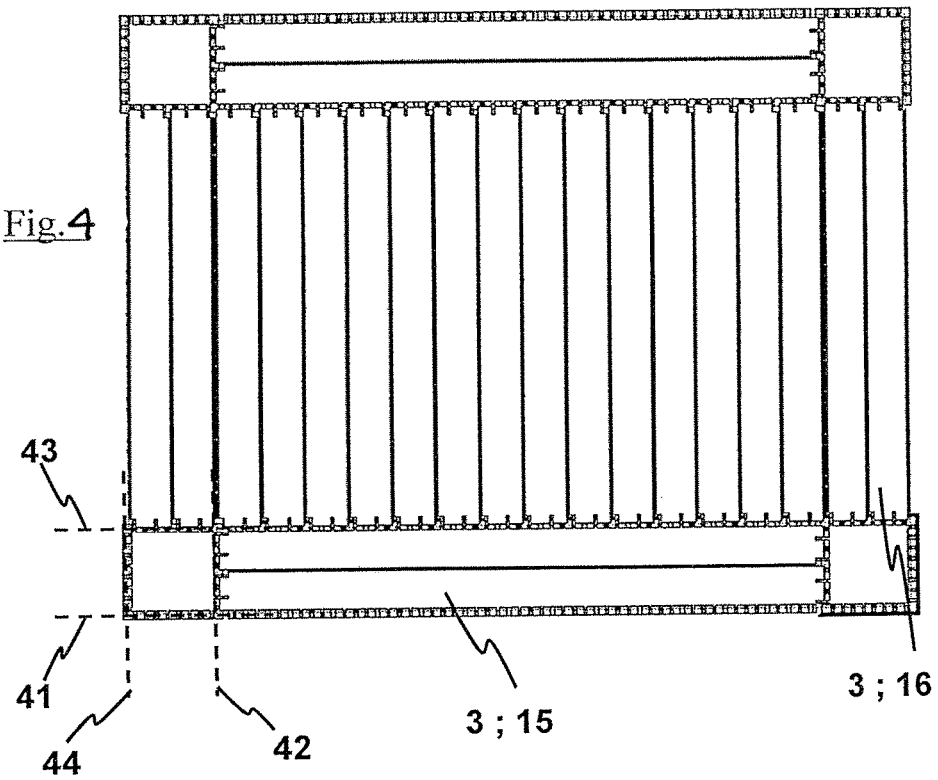
FIG. 4 is a plan view of an assembly of columns, beams and slab segments.
Figure 5:
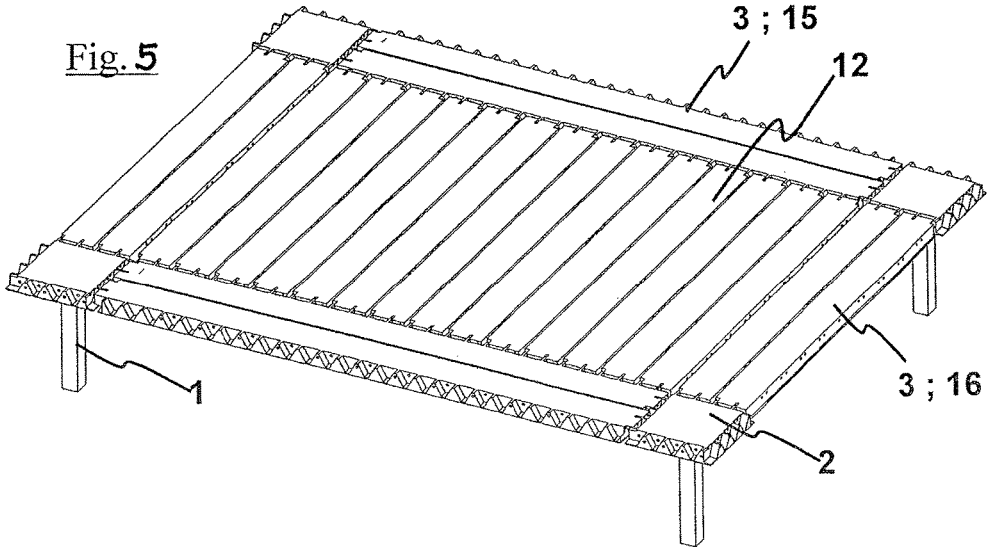
FIG. 5 is a perspective view of an assembly of columns, beams and slab segments.
Figure 6:
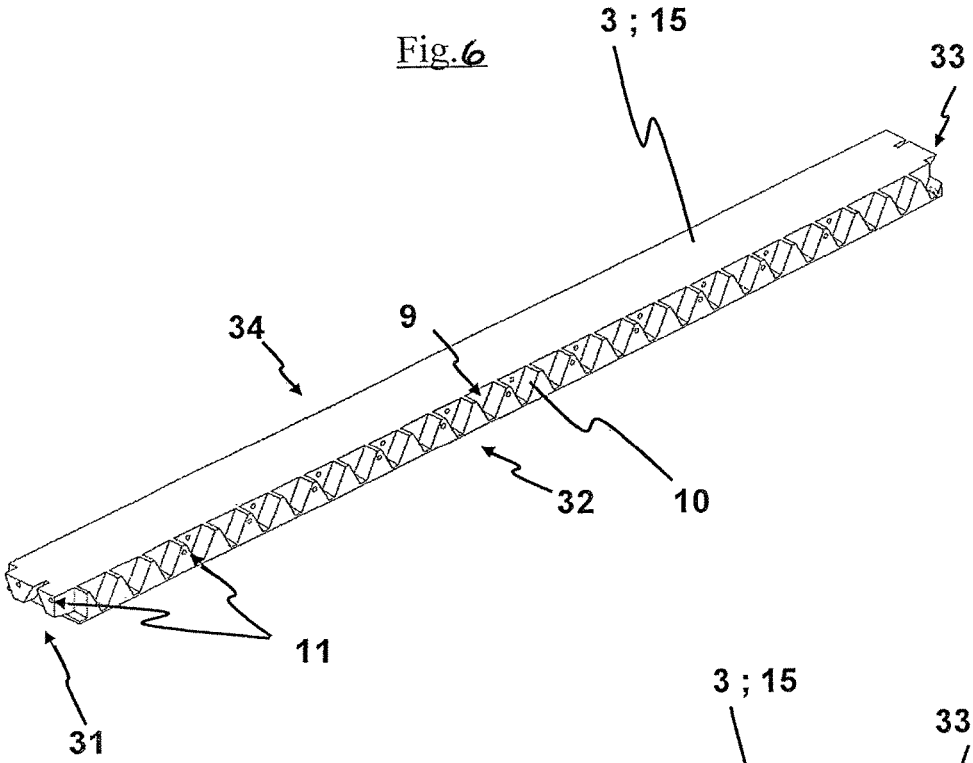
FIGS. 6 and 7 show main beams with concave recesses of concrete according to the invention.
Figure 7:
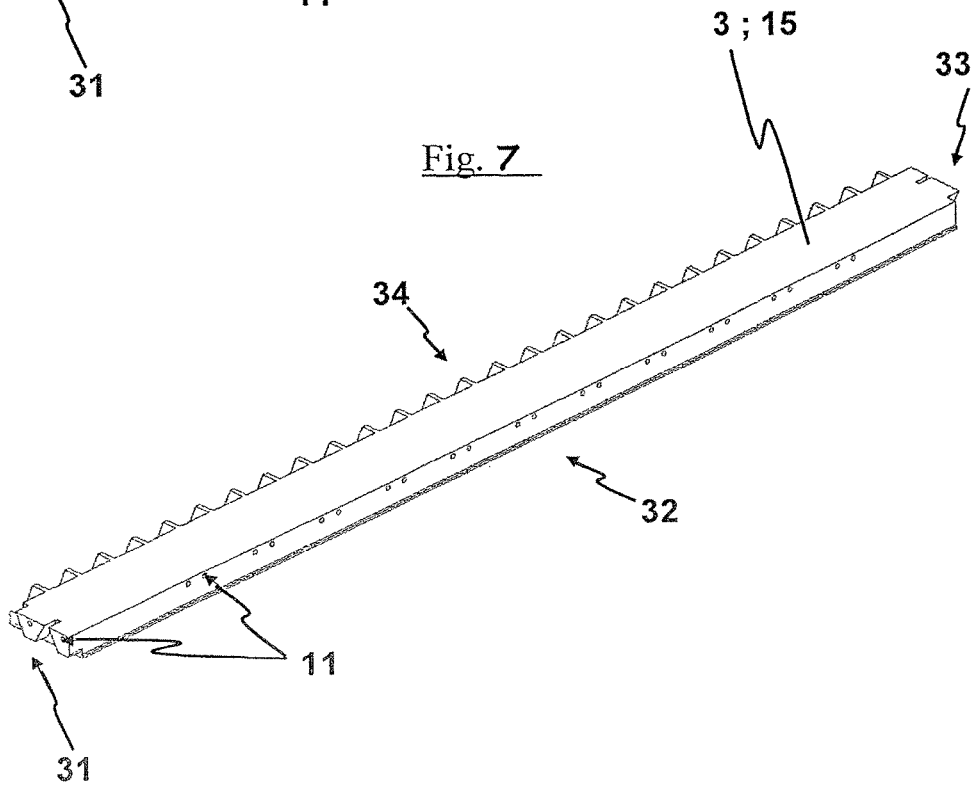
Figure 8:
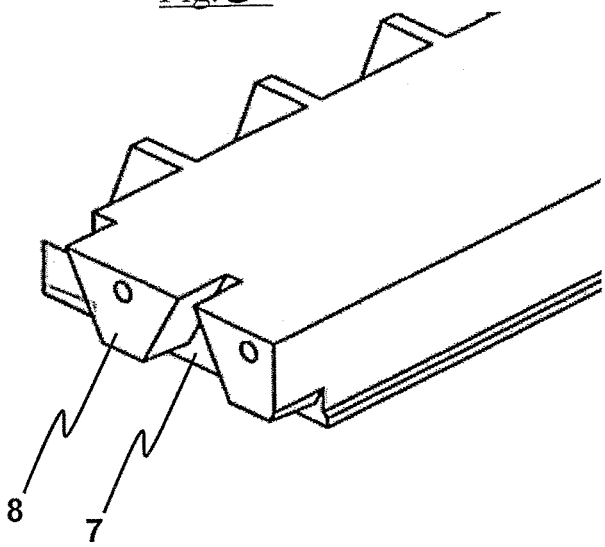
FIG. 8 shows the end side of a main beam in detail, with convex protrusions of concrete.

As shown in the figures, the invention refers in a general manner to a support column 1 for modular structure of precast concrete, comprising on its upper part a bearing capital 2 of beams 3, having the bearing capital 2 a square or quadrangular plan in such a way that four sides 21, 22, 23, 24 are defined that support the beams 3.

Specifically, in the structure of the invention each of the sides 21, 22, 23, 24 comprises concave recesses 4 of sides parallel to the axis of the beams that define convex protrusions 5 which sides comprise bearing surfaces 6 such that when laying a beam 3, which ends are complementary to said recesses 4, the bearing forces have directions contained in a plane 41, 42, 43, 44 perpendicular to the axis of the beam 3, having said directions a horizontal component.

Figure 13:
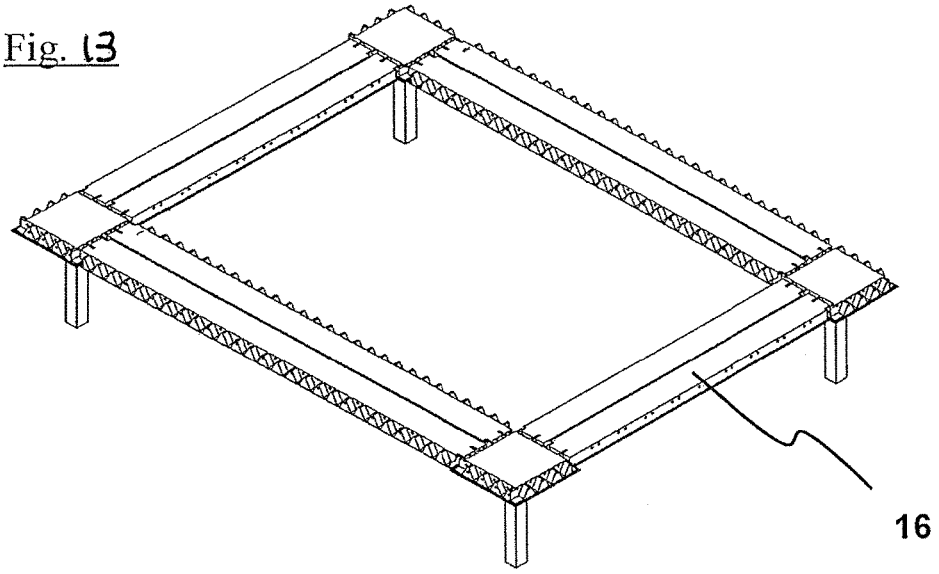
Figure 14:
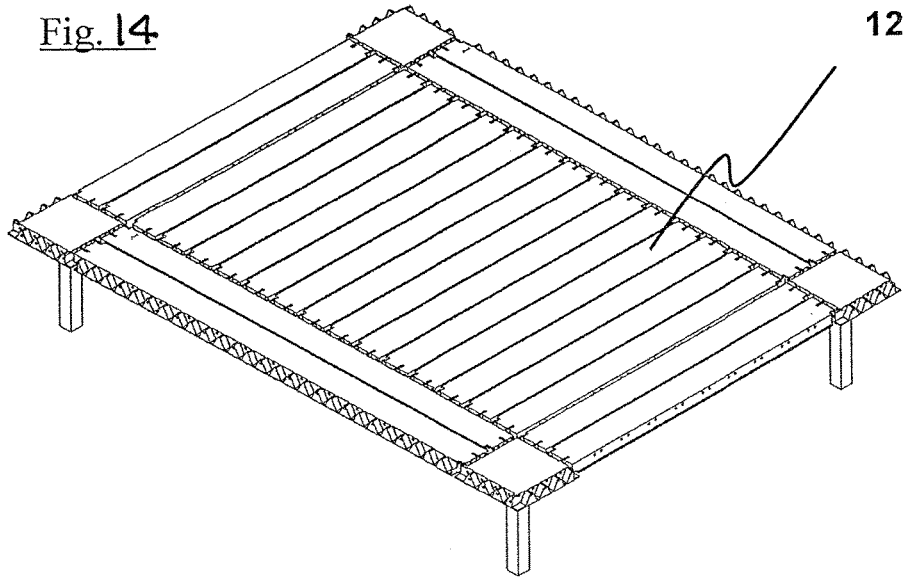
Figure 15:
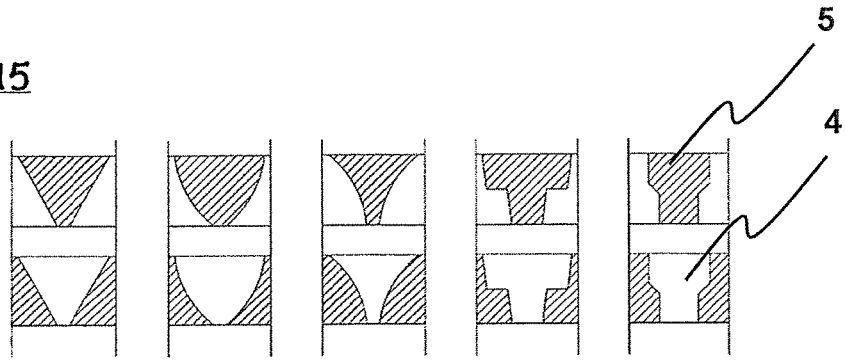
FIG. 15 shows variants of the section of the recesses.
Figure 16:
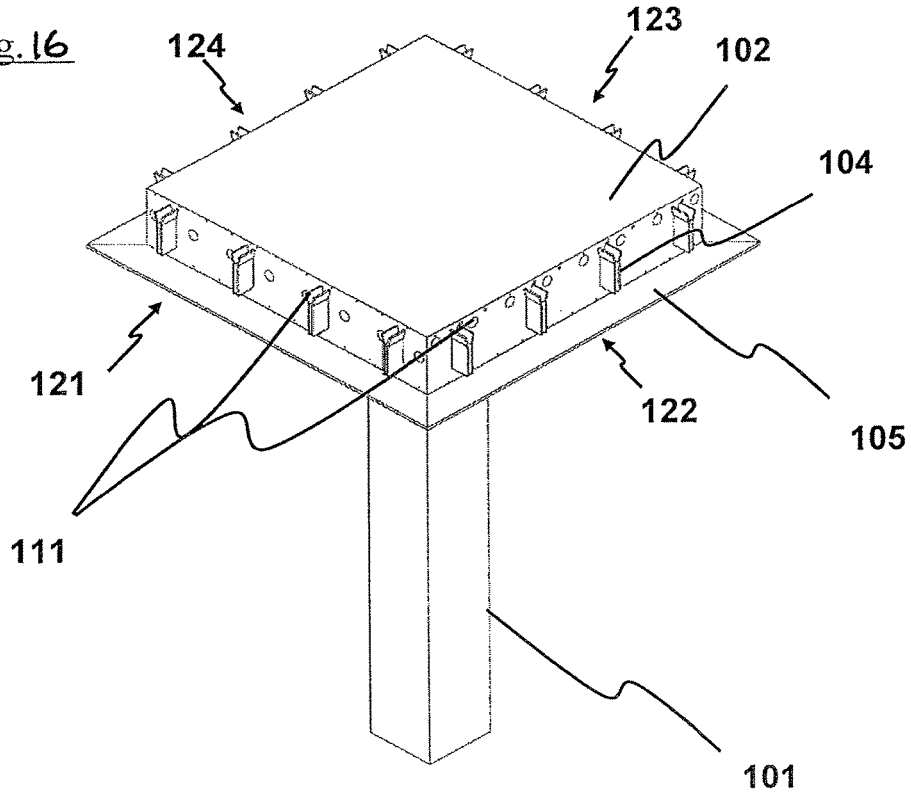
FIG. 16 is a perspective view that shows a column with rigid flaps according to the invention.
Figure 17:
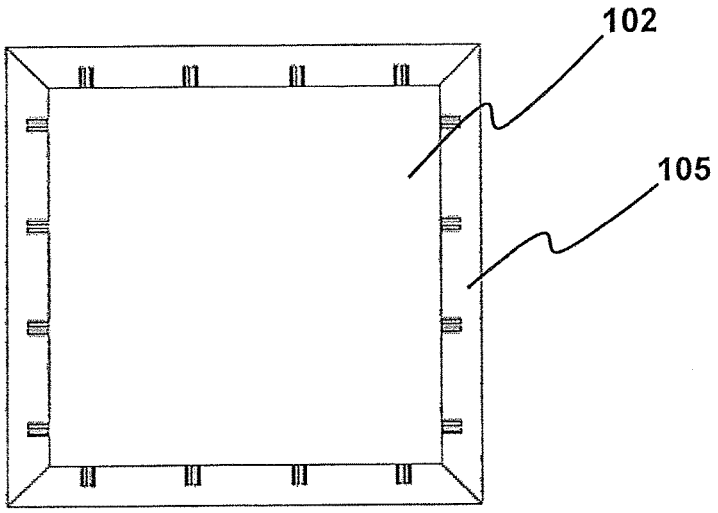
FIG. 17 is a plan view of the capital of the column with rigid flaps.
Figure 18:
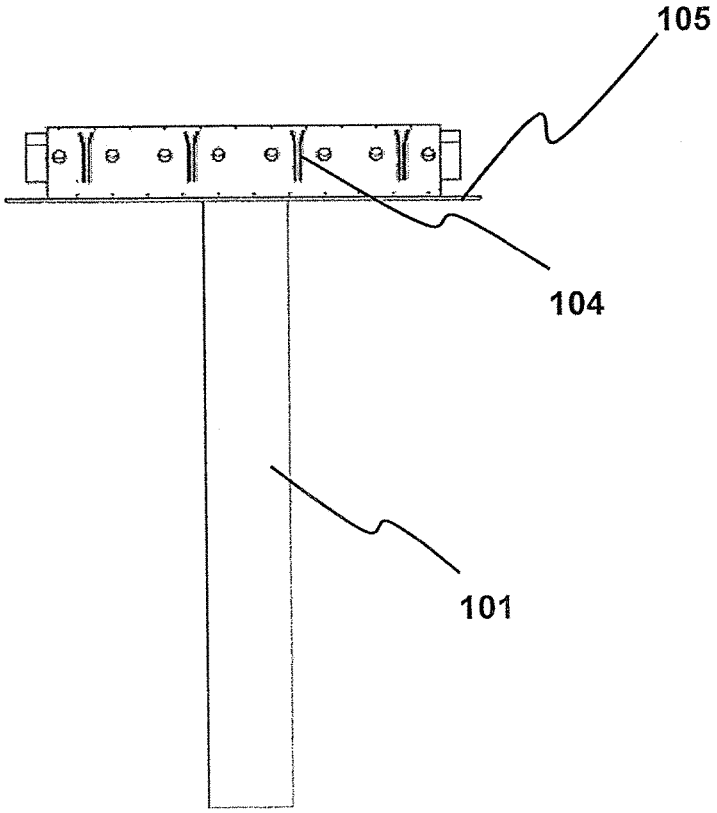
FIG. 18 is an elevation of the column with rigid flaps.

These concave recesses 4 can be triangular or trapezoidal, or another compatible shape, such as already described in FIG. 13.

Also, as shown in FIG. 1, the four sides 21, 22, 23, 24 of support for the beams 3 comprise, in its bottom side, a protruding flap 14 intended to contain the grout of the joint between the beams and the column.

Alternatively, in the structure of the invention, each of the sides 121, 122, 123, 124 includes a rigid flap 105 that protrudes and is attached to the bottom side of the capital, and possesses rigid flat rails 104 included in the vertical side of the capital that in turn are parallel to the axis of the beam 103 that is supported on that side, including the side end of said beam rigid flat plates 107 incorporated to the end of the beam that fit in the rails 104 of the capital.

Figure 27:
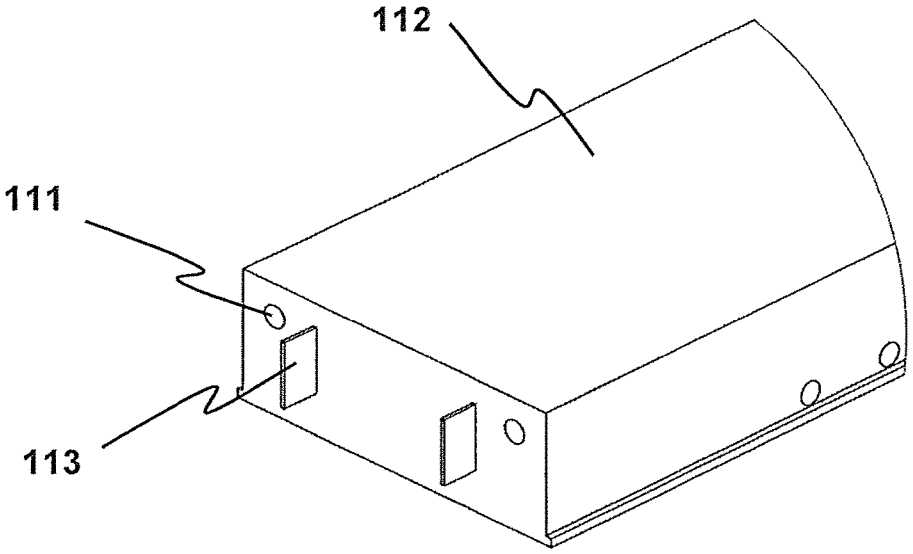
Figure 28:
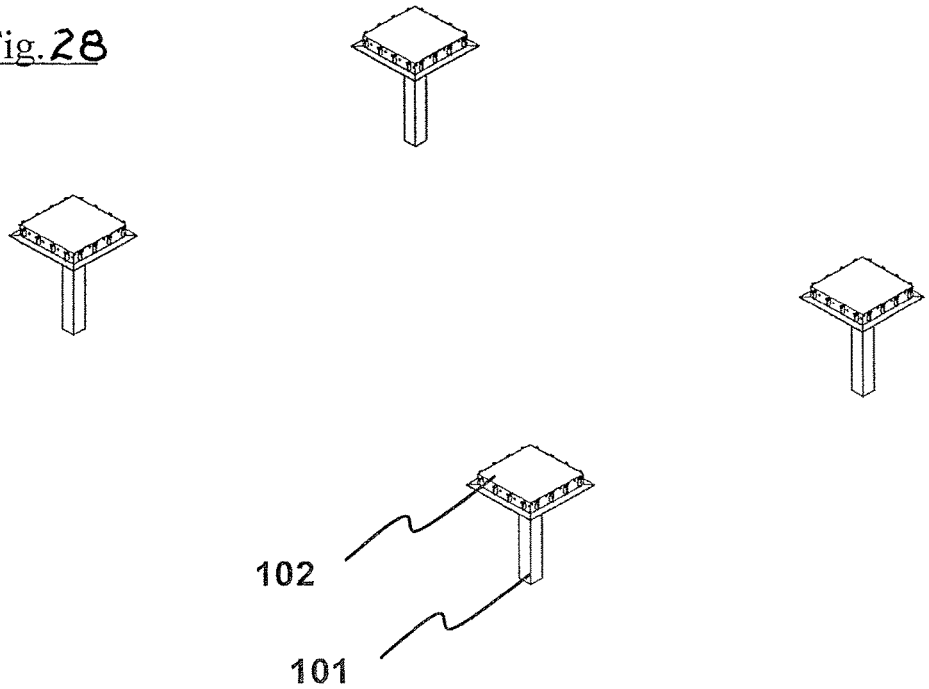
FIGS. 28, 29, 30, and 31 show the four main stages of erection of the main elements of the structure, in the variant of support by means of rigid flaps.
Figure 29:
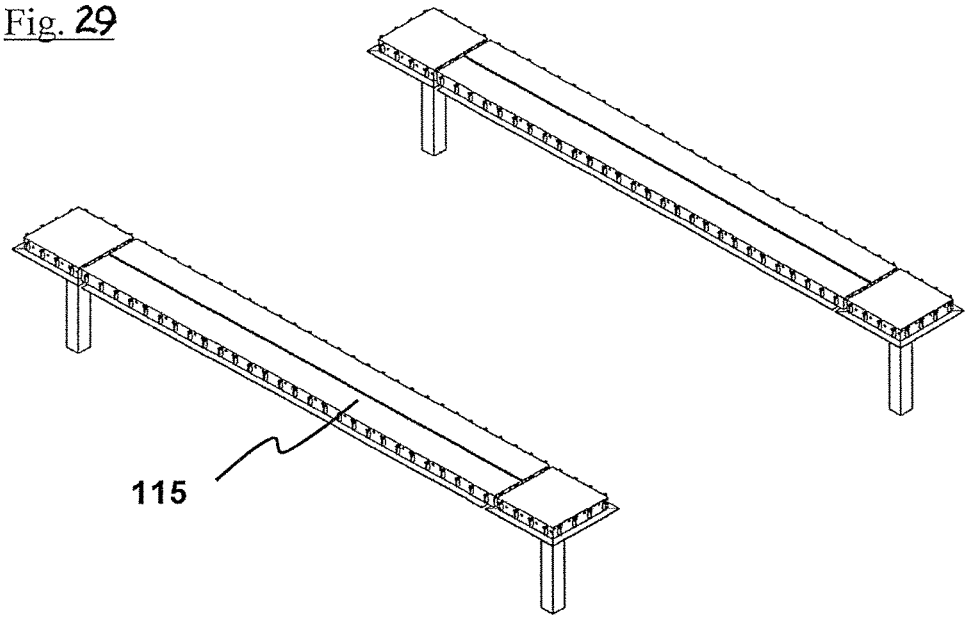
Figure 30:
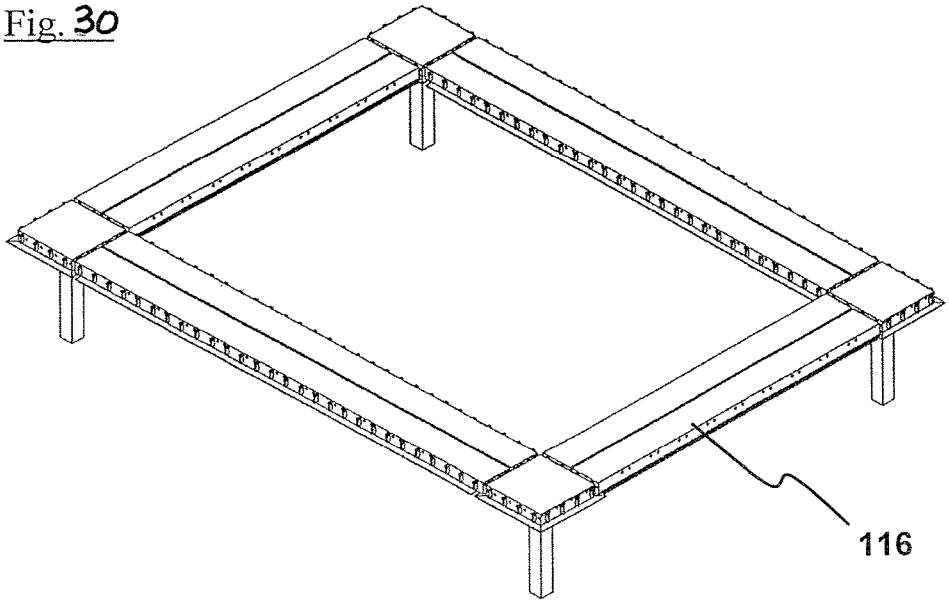
Figure 31:
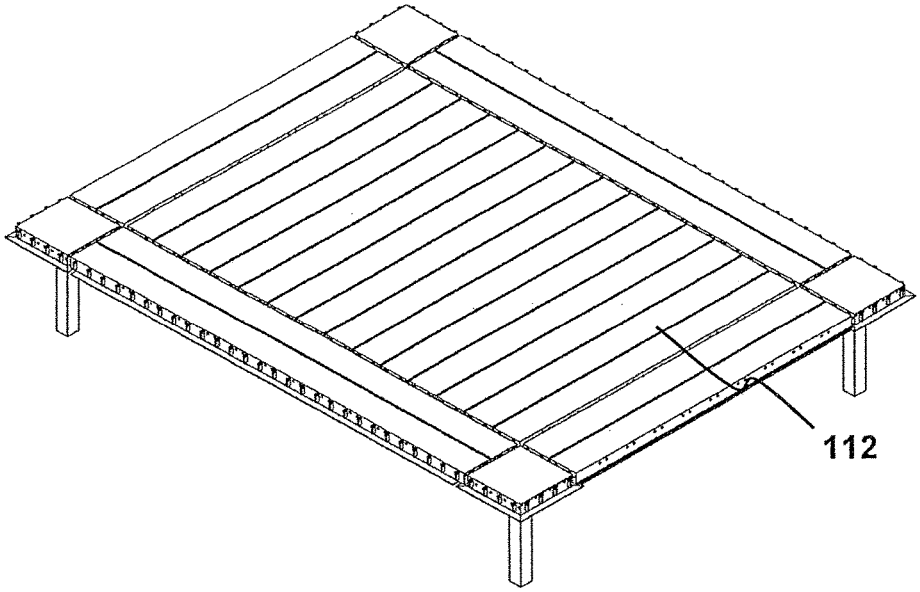

As shown in FIG. 1 and in FIG. 27, independently of what the variant of the invention is, the support capital includes passing through duct segments 11 or 111 in such a way that they allow the passage of post-tensioning tendons.

The invention also refers to a wide (not down-dropping) beam 3 of prestressed precast concrete for rectangular modular structure, specially conceived to be installed on the column of the invention, in such a way that four sides 31, 32, 33, 34 are defined, two of the end sides 31, 33 for the support on columns 2, which characterize in that each of the end sides 31, 33 comprises convex recesses 7 of sides parallel to the axis of the beam that comprise bearing surfaces 8 such that when bearing the beam 3 over the bearing capital 2 of a column 1 provided with protrusions 5 complementary to said recesses 7, the bearing forces have directions contained in a plane 41, 42, 43, 44 perpendicular to the axis of the beam 3, having said directions a horizontal component.

At least one of the long sides 32, 34 of the beam 3 comprises concave recesses 9 of sides parallel to the axis of the slab segments that comprise bearing surfaces 10 such that when bearing the slab segments 12, which ends are complementary to said recesses 9, the bearing forces have directions contained in a plane 41, 43 perpendicular to the axis of the slab segments 12, having said directions a horizontal component.

Alternatively, the invention also refers to a wide (not down-dropping) beam 103 of precast prestressed concrete for quadrangular modular structure, specially conceived to be assembled in the column of the invention 101, in such a way that four sides 131, 132, 133, 134 are defined, two of the end sides 131, 133 for the support in columns 101, which characterize in that each of the end sides 131, 133 comprises rigid flat plates 107 incorporated at the end of the beam that fit in the flat rigid rails 104 included in a the vertical side of the bearing capital 102 of the column.

At least one of the long sides 132, 134 of the beam 103 comprises a rigid flap 108 that protrudes and is attached to the bottom side of the beam 103.

As shown in the FIGS. 4 5, 19 and 20, the invention also refers to a structure 50 (or 150) composed by at least two columns 1 (or 101), a beam 3 (or 103) and its corresponding post-tensioned reinforcement according to any of the variants of the invention.

Figure 9:
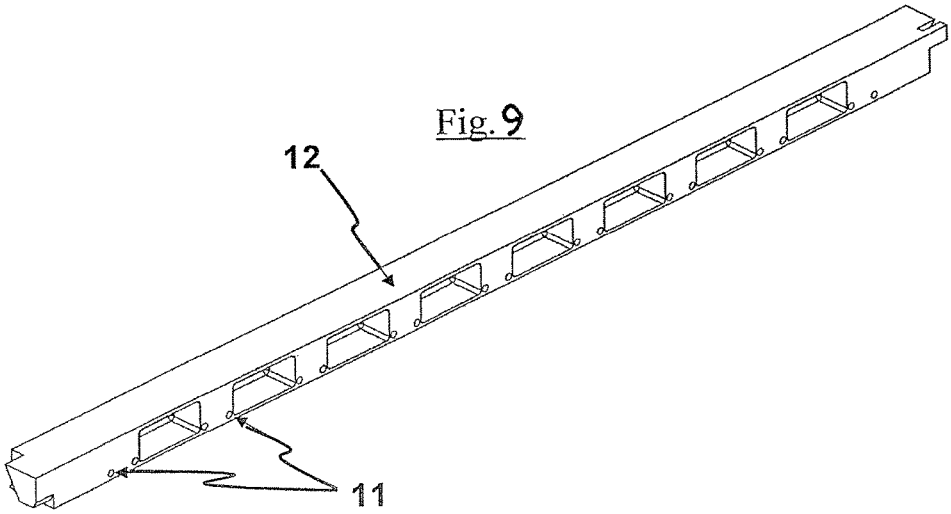
FIG. 9 shows a section of a lightweight slab segment with double-T section.
Figure 10:
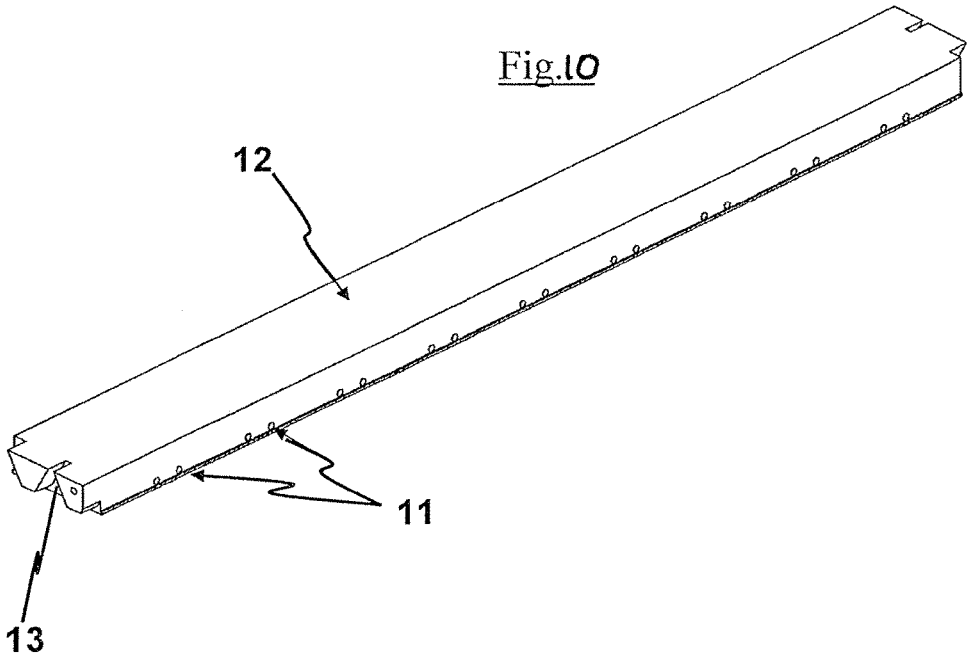
FIG. 10 shows a slab segment.
Figure 11:
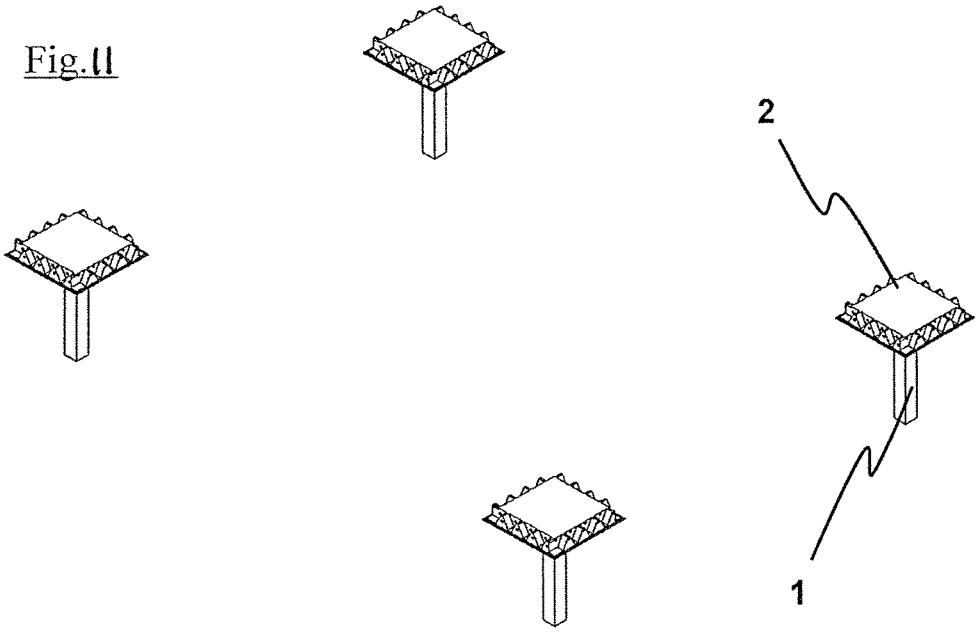
FIGS. 11, 12, 13 and 14 show the four main stages of erection of the main elements of the structure.
Figure 12:
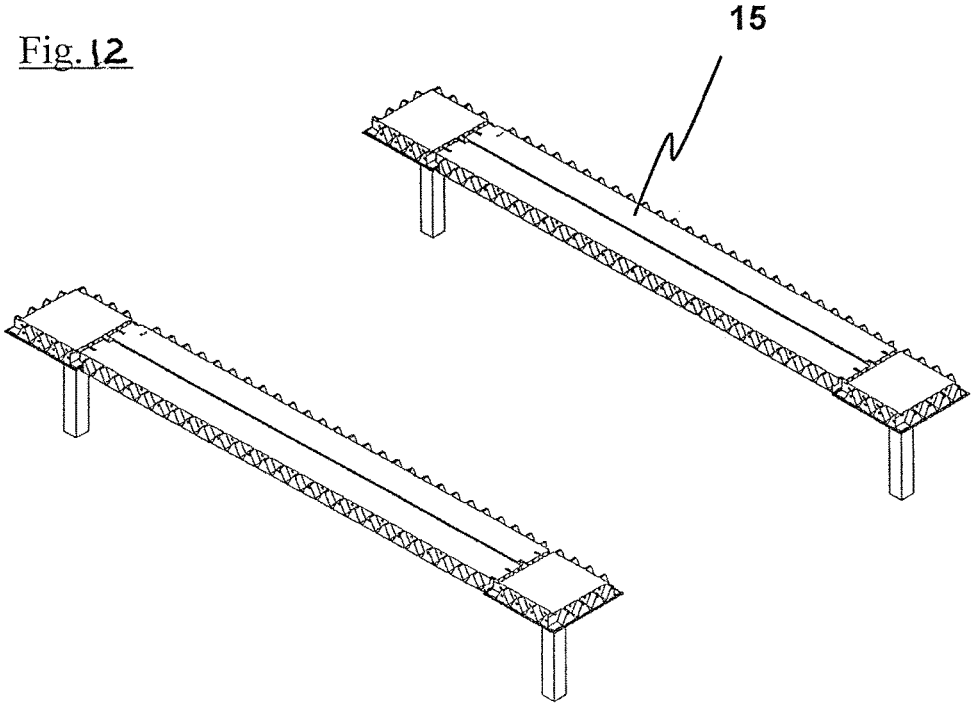

FIGS. 9 and 10 show slab segments 12 provided with convex recesses 13 for the support on the long sides 32, 34 of the beams 3, which allow a support in the previously described conditions.

Figure 19:
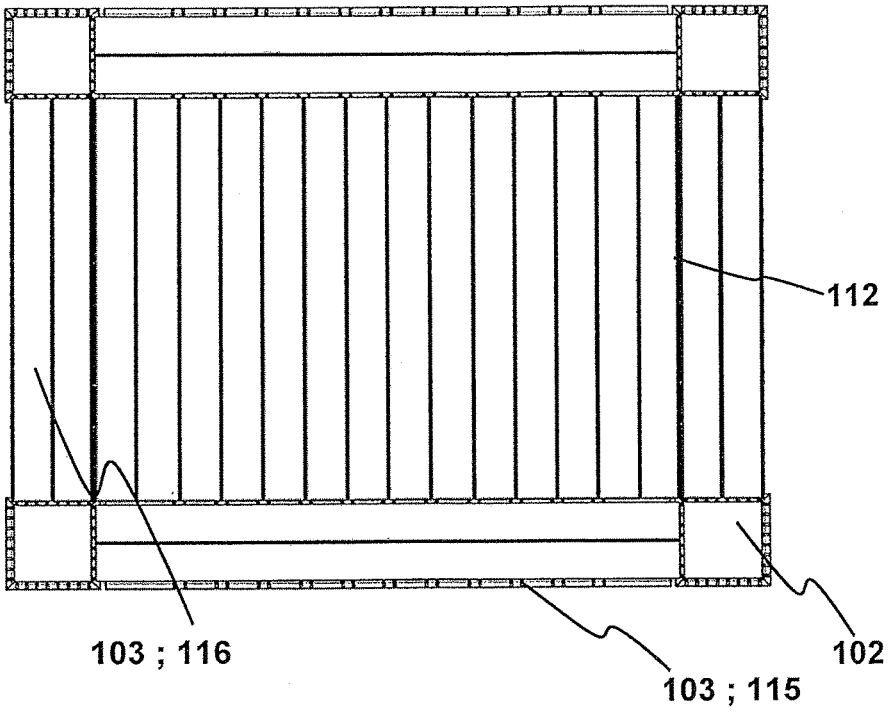
FIG. 19 is a plan view of an ensemble of columns, beams and slab segments, in the variant of support by means of rigid flaps.
Figure 20:
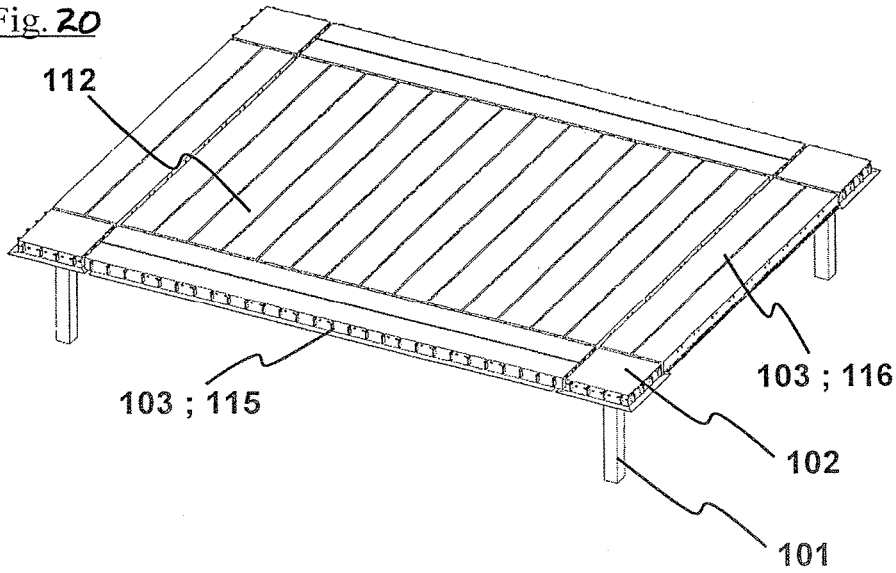
FIG. 20 is a perspective view of an assembly of columns, beams and slab segments, in the variant of support by means of rigid flaps.
Figure 21:
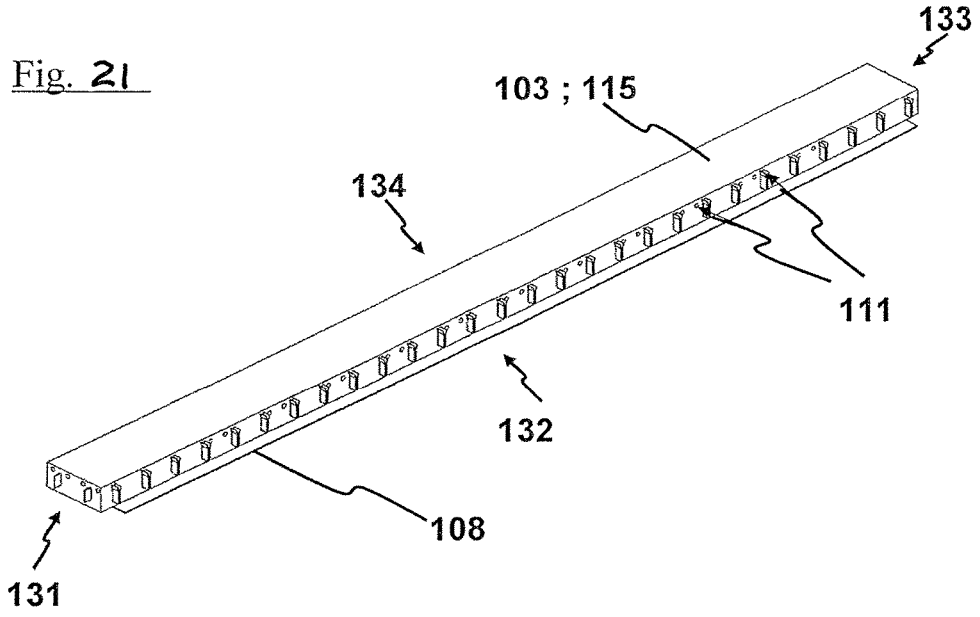
FIGS. 21 and 22 show some main beams in the variant of support by means of rigid flaps.
Figure 22:
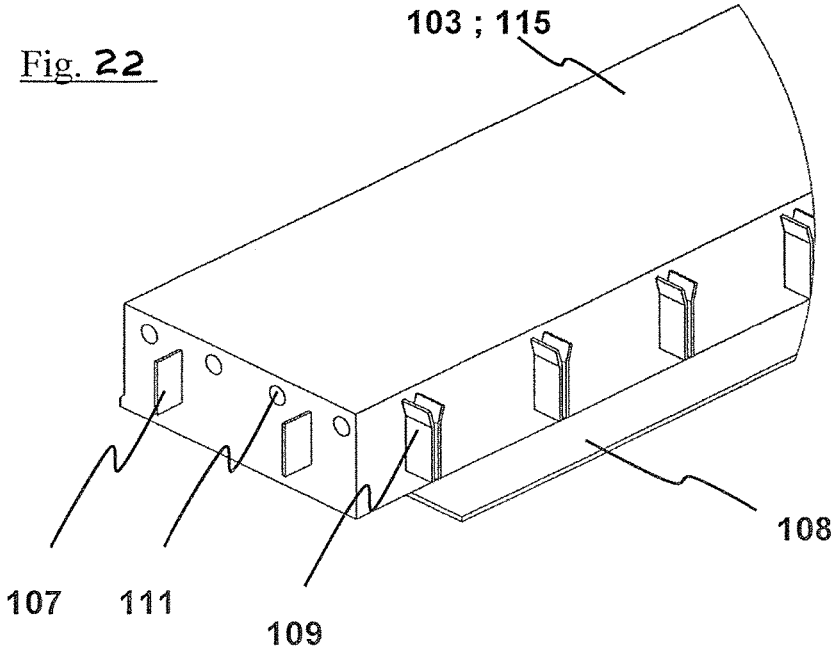
Figure 23:
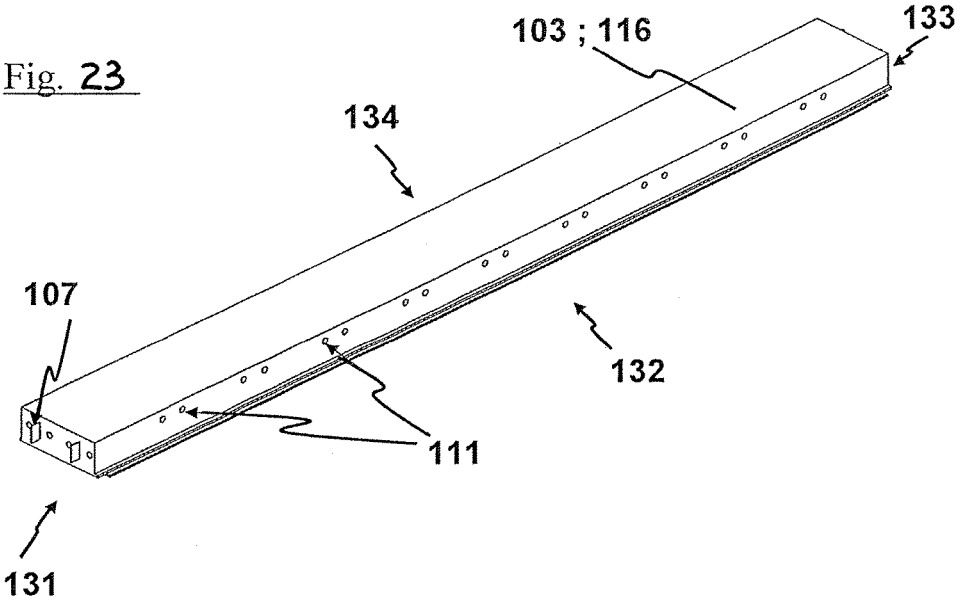
FIGS. 23 and 24 show some secondary beams in the variant of support by means of rigid flaps.
Figure 24:
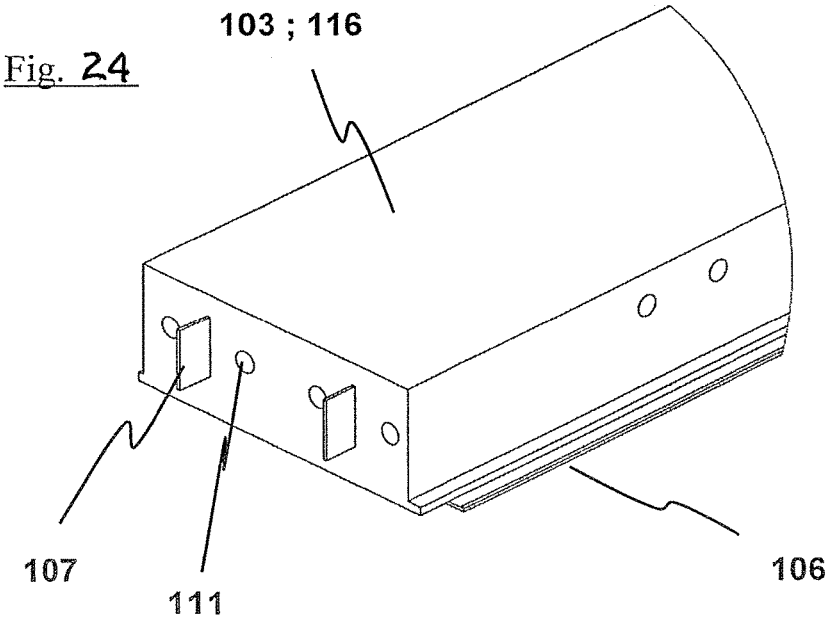
Figure 25:
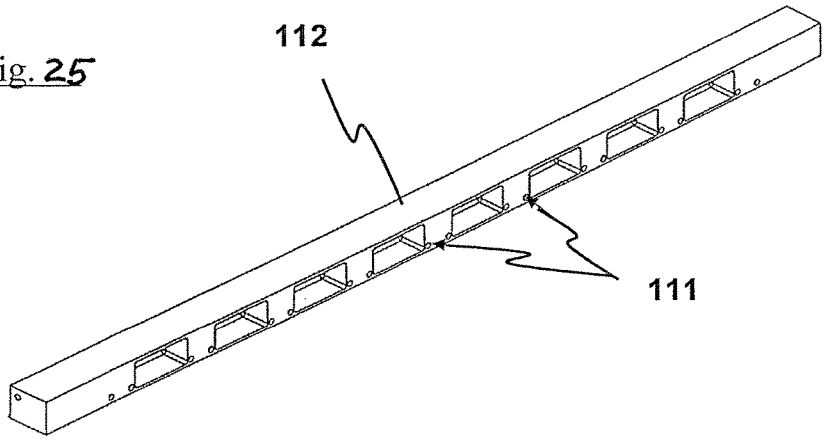
FIG. 25 shows one section of a lightweight slab segment with double-T section, in the variant of support by means of rigid flaps.
Figure 26:
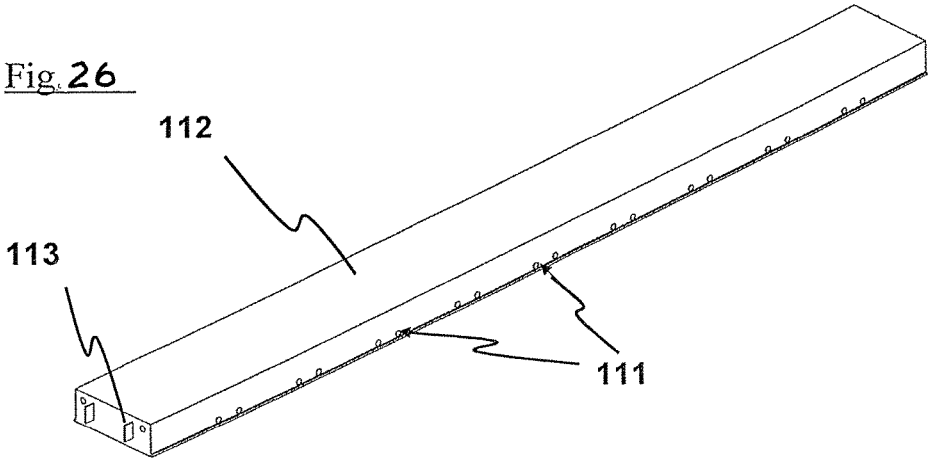
FIGS. 26 and 27 show a slab segment, in the variant of support by means of rigid flaps.

Alternatively, the FIGS. 19 and 20 show slab segments 112 of precast prestressed concrete that include in each of its end sides rigid flat plates 113 incorporated to the end of the slab segment 112 that fit in the rails 109 of the long sides 132, 134 of the beams 103.

FIGS. 11 to 14 and 28 to 31 show the four main stages of the structure erection in its two variants.

First of all the columns are put in place. Subsequently the main beams 15 (or 115) are put in place, which will support the slab segments. The inventive characteristics allow this stage to be embodied without the need of shoring or formworks, and allow significant assembly tolerances.

After bearing the beams 3 (or 103) on the capitals 2 (or 102) of the columns 1 (or 101), preferably the pouring non-shrinking grout in the joints between the main beams and the capitals will be done. Next, the threading, tensioning and anchoring of the tendons of the main beams 15 (or 115) will be carried out. This way a reverse camber will be obtained in the beams 3 (or 103) that will improve their capacity to support the weight of the slab segments 12 (or 112) and the live and dead loads that the latter will transfer to the beams 3 (or 103).

Next, the slab segments 12 (or 112) that will compose the structural floor will be put in place. Afterwards, the pouring of non-shrinking grout is to be done in every joint between elements. Once hardened, the threading, tensioning and anchoring of the remaining post-tensioning tendons will be carried out, in secondary beams 16 (or 116) and in slab segments 12 (or 112). Finally the injecting of ducts will be executed.

The grouting of joints, threading and post-tensioning done in two phases as just described is not imperative, but allows a noteworthy optimization of the structural behaviour. In the event that the grouting of joints, threading, post-tensioning and anchoring are executed in only one phase, the main beams 15 (or 115) may need a significant additional amount of pretensioned and/or passive reinforcement.

Nonetheless a specific embodiment of the invention has been referred to, it is obvious to an expert in the field that the column, the beam and the structure described are susceptible of multiple variations and modifications, and that all the mentioned details can be substituted by other technically equivalents, without deviating from the scope of protection defined by the attached claims.

The invention claimed is:

1. Precast concrete column (1) for the support of structural modular floor, dry assembled, comprising on its upper part a capital for the support (2) of beams (3), having the support capital (2) a square or quadrangular plan in such a way that four sides (21, 22, 23, 24) are defined for the support of the beams (3), wherein each of the sides (21, 22, 23, 24) comprises concave recesses (4) of sides parallel to the axis of the beams (3) that define convex protrusions (5) which sides comprise bearing surfaces (6) such that when laying a beam (3), which ends are complementary to said recesses (4), the bearing forces have directions contained in a plane (41, 42, 43, 44) that is perpendicular to the axis of the beam (3), said directions having a horizontal component.

2. Column according to claim 1, in which the concave recesses (4) are triangular or trapezoidal.

3. Column according to claim 1 in which the support capital includes passing through duct segments (11) in such a way that they allow threading the post-tensioning tendons.

4. Column according to claim 1, comprising at least two recesses (4).

5. Column according to claim 1 in which all four sides (21, 22, 23, 24) for the support of beams (3) comprise a protruding flap (14) in its bottom side intended to contain the grouting of the joints between the beams and the column.

6. Rectangular or quadrangular plan precast wide beam (3) made of prestressed concrete for modular structural floor, dry assembled, in such a way that four sides (31, 32, 33, 34) are defined, two of them being end sides (31, 33) for bearing the columns (1), wherein each of the end sides (31, 33) comprises convex recesses (7) of sides parallel to the axis of the beam that comprise bearing surfaces (8) such that, when laying the beam (3) on a bearing capital (2) of a column (1) provided with protrusions (5) complementary to said recesses (7), the bearing forces have directions contained in a plane (41, 42, 43, 44) perpendicular to the axis of the beam (3), said directions having a horizontal component.

7. Beam (3) according to claim 6, wherein an axis of the beam is parallel to the long sides (32, 34) in which at least one of the long sides (32, 34) comprises concave recesses (9) of sides parallel to an axis of a slab segment (12) that comprise bearing surfaces (10) such that, when laying on the beam (3) the slab segments (12), which ends are complementary to said recesses (9), the bearing forces have directions contained in a plane (41, 43) perpendicular to the axis of the slab segments (12), said directions having a horizontal component.

8. Beam according to claim 6 that includes passing through duct segments (11) in such a way that they allow the threading of the post-tensioning tendons.

9. Beam according to claim 6 in which one or two of its long side(s) comprise in its (their) bottom side a protruding flap (106, 108) intended to contain the grouting of the joints between the slab segments and the beam.

10. Structure (50) composed by at least two columns (1) according to claim 1, and at least one beam (3) made of prestressed concrete for modular structural floor, dry assembled, in such a way that four sides (31, 32, 33, 34) are defined, two of them being end sides (31, 33) for bearing the columns (1), wherein each of the end sides (31, 33) comprises convex recesses (7) of sides parallel to the axis of the beam that comprise bearing surfaces (8) such that, when laying the beam (3) on a bearing capital (2) of a column (1) provided with protrusions (5) complementary to said recesses (7), the bearing forces have directions contained in a plane (41, 42, 43, 44) perpendicular to the axis of the beam (3), said directions having a horizontal component.

11. Structure according to claim 10, comprising slab segments (12) provided with convex recesses (13) for support over the long sides (32, 34) of the beams.

12. Structure according to claim 11 in which the slab segments (12) include passing through duct segments (11) in such a way that they allow the threading of the post-tensioning tendons.

13. Structure according to claim 11 in which the bottom sides of the slab segments (12) comprise protruding flaps (106, 108) intended to contain the grouting of the joints between the slab segments or with the beams parallel to them.

* * * * *